US007470847B2

(12) United States Patent
Kitagawa

(10) Patent No.: US 7,470,847 B2
(45) Date of Patent: Dec. 30, 2008

(54) PEDAL SYSTEM AND METHOD

(75) Inventor: Masahiro Kitagawa, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 0 days.

(21) Appl. No.: 11/999,346

(22) Filed: Dec. 5, 2007

(65) Prior Publication Data

US 2008/0098873 A1 May 1, 2008

(30) Foreign Application Priority Data

Dec. 6, 2006 (JP) ..... 2006-328958

(51) Int. Cl.
*G10D 3/00* (2006.01)

(52) U.S. Cl. ..... 84/422.1

(58) Field of Classification Search ..... 84/422.1, 84/422.2, 422.3

See application file for complete search history.

(56) References Cited

U.S. PATENT DOCUMENTS

2004/0025667 A1* 2/2004 Hampton, Jr. ..... 84/426

FOREIGN PATENT DOCUMENTS

JP U H06-008998 2/1994
JP A H09-097075 8/1997

* cited by examiner

*Primary Examiner*—Kimberly R Lockett
(74) *Attorney, Agent, or Firm*—Foley & Lardner LLP

(57) ABSTRACT

An electronic percussion instrument pedal device uses a spring structure in a space between a bottom structure and a foot pedal board structure to regulate the movement of the foot pedal board structure. Even when the foot pedal board structure is not being moved, it is regulated by the above mentioned spring structure into a proper near horizontal position. If the foot board is stepped on, the coil spring will stretch and a load (stability) will become strong. As a result, when the foot board is in a position near the position in which it is not stepped on, the load is initially relatively light and then becomes heavier as the user continues to further step on the foot board. This is approximated to the action of an acoustic bass drum, and a good actuation feeling.

15 Claims, 10 Drawing Sheets

PEDAL SYSTEM AND METHOD

CROSS-REFERENCE TO RELATED PATENT APPLICATIONS

Japan priority application number 2006-328958, filed on Dec. 6, 2006 is incorporated herein by reference in its entirety.

BACKGROUND OF THE INVENTION

This invention relates to pedal device configurations for electronic percussion instrument pedals, and methods of making and using the same.

There are various kinds of electronic percussion instruments. Among them are some that have pedal devices with acoustic bass drums and some in which only a bass drum pedal device is used. The basic structure of the electronic percussion instrument pedal device for an acoustic bass drum has been similar to an electronic percussion instrument pedal device structure. In both structures, the drum head is struck by the downward pressure applied to a foot pedal which is connected to a lever system that moves a beater to strike the drum head to function and produce sounds. Depending upon the power, pressure and duration of the strike, different sounds are produced.

An electronic percussion instrument pedal device is disclosed in the Japanese public patent number 6-8998. In that device, a beater unit is used to strike the head of a drum face to produce sound. The head of the drum is backed by a sensor unit in order to electronically detect the hits made upon the drum head surface. The electronic detections are then converted to data that are conveyed through various available media to produce sounds electronically.

Another electronic percussion instrument pedal device is disclosed in the Japanese public patent number 9-97075. In that device, when the foot pedal is stepped on, it activates a sensor for an electronic high hat device. A structure of such a high hat device is shown in FIG. 10. It is struck by depressing the pedal unit 102 towards the bottom structure 105. Between the bottom surface 105 and pedal unit 102, there is a main spring structure 110. The angle of deflection between the pedal device 102 and the bottom structure 105 is set at an angle greater than 0.

In the pedal structure, the starting position of the pedal 102 is set by another spring structure 112. At a lower portion of s shaft structure 120 which is attached to the pedal unit 102, is a sensor pressing member 107. The sensor pressing member 107 is activated when depressed by the plank structure 103 which is moved downwards as a result of downward pressing of the pedal unit 102 by a foot action. Beneath the sensor pressing member 107 is located the sensor pattern 108. When the sensor pressing member 107 comes in contact with the sensor pattern 108, the degree of contact will dictate the level of electrical impulse which will be sent along through the system. According to the impulses sent, sound reconstruction will take place.

One of the limitation of the device of the first Japanese patent document number described above, is that it required the beater head to physically strike the drum head and thus causing the generation of some unwanted secondary sounds.

SUMMARY OF THE DISCLOSURE

Embodiments of an electronic percussion instrument pedal device are disclosed. Such embodiments utilize a spring structure in a space between a bottom surface structure and a foot pedal board structure to detect, via a sensor, the movement of the foot pedal board structure relative to the bottom surface structure. When the foot pedal board structure is not pressed, its position is regulated by the above mentioned spring structure along a line from the rotating shaft to a spring stop shaft. In this way, the ability to adjust the foot pedal board structure relative to the bottom surface structure is accomplished via the adjustment of the spring structure. This spring structure can also adjust the angle of the foot pedal board structure relative to the above mentioned bottom surface structure. The spring structure can also be adjusted to enhance the strength of the striking power of the above mentioned foot pedal board structure.

In one embodiment, the relative height of the above mentioned foot pedal board structure and the above mentioned spring structure are regulated with respect to each other via the inclusion of securing structures that connect directly to the spring structure.

In another embodiment, insulated electrodes are provided to communicate data from the sensors as output. These electrodes may be attached to the foot board structure via an insulated shock resistant connection structure which allows the connection between the sensor and the foot board structure to be maintained despite undesired movements.

In another embodiment, the securing structures create contact with the sensors and the insulated electrodes.

BRIEF DESCRIPTION OF THE DRAWINGS

FIG. 2(*b*) is a side, cross-section view of the pedal device according to the embodiment of the FIG. 1;

FIG. 5(*b*) is a side, cross-section view of a foot board structure while in play;

FIG. 7(*b*) is a side, cross-section view of a foot pedal device according to the third embodiment of the present invention;

DETAILED DESCRIPTION

A food pedal device according to a first embodiment of the present invention includes a foot board structure, where the up and down motion, as well as the limits set upon the motion of the foot board structure is regulated via a spring structure. There are also sensors connected to the foot board structure which sense movements in the structure. The spring structure also maintains the foot board structure at a position level that provides easy strike access to the user when it is not in use. The spring structure can also be utilized to regulate the angle of the resting position for the foot board structure. This set up also allows the foot board structure to utilize the return spring energy to increase the power of the strikes when the foot board structure is stepped upon. As a result, an artist user may find the pedal device to be relatively easy and comfortable to adapt to and use.

This system can provide ease and comfort of use by being very close to the feel of using a real acoustic bass drum when the artist strikes it. Thus for artists who have learned to play on real acoustic bass drums, the feeling is not too dissimilar and thus makes this system much easier to adapt to.

Figure 9:
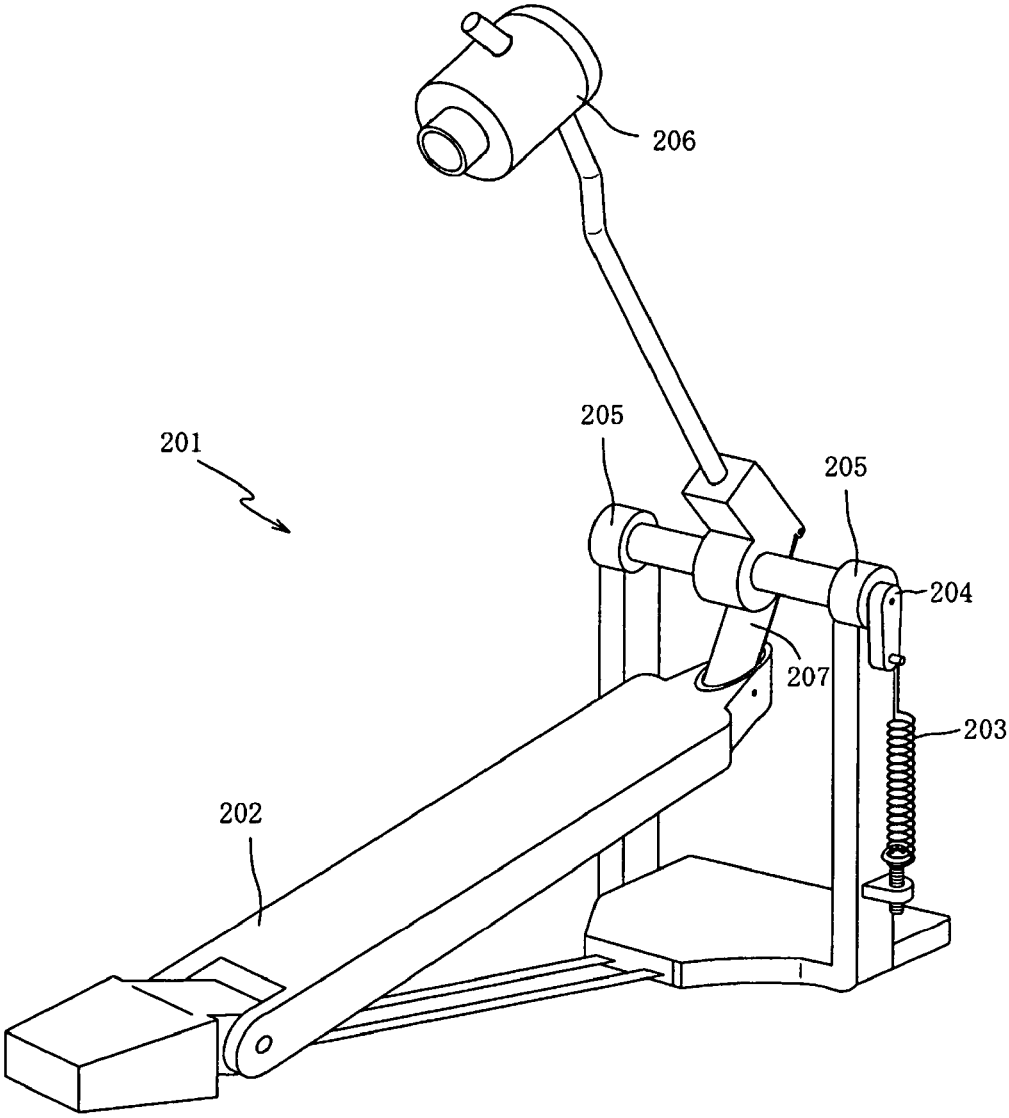
FIG. 9 is an illustration for comparison of a conventional style acoustic bass drum pedal configuration.

As shown in FIG. 9, a pedal device 201 for an acoustic bass drum includes a foot board structure 202 and a rotary shaft structure 205 that is arranged to rotate the beater rod on which a beater 206 is attached. An arm 204 is fixed to the rotary shaft 205 and has one end connected to, at a lock point, to an end of a spring structure 203. In the situation where the foot board structure 202 is not operated, the spring structure 203 pulls the end of the arm 204 downward. As a result, the beater 206 is held at the distance which is separated from a face of a percussions surface, and the foot board structure 202 is held at a prescribed angle relative to the floor.

The arm 204 is supported by the shaft structure 205. The lock point section of the arm 204 at which the spring structure 203 is attached moves in an arc motion having a radius centered at the axis of the shaft structure 205.

The spring structure 203 pulls the arm 204 downward. As a result, when a lock point for the spring structure 203 is in the lowest position, only a relatively small load on the foot board structure 202 need be applied to cause a change of a rotation angle.

However, the load becomes larger as the shaft structure 205 rotation angle becomes larger. Because the beater 206 has a certain amount of mass, when the beater 206 begins to move, the user can experience a good actuation feeling, based on the inertia of the beater 206.

Figure 8:
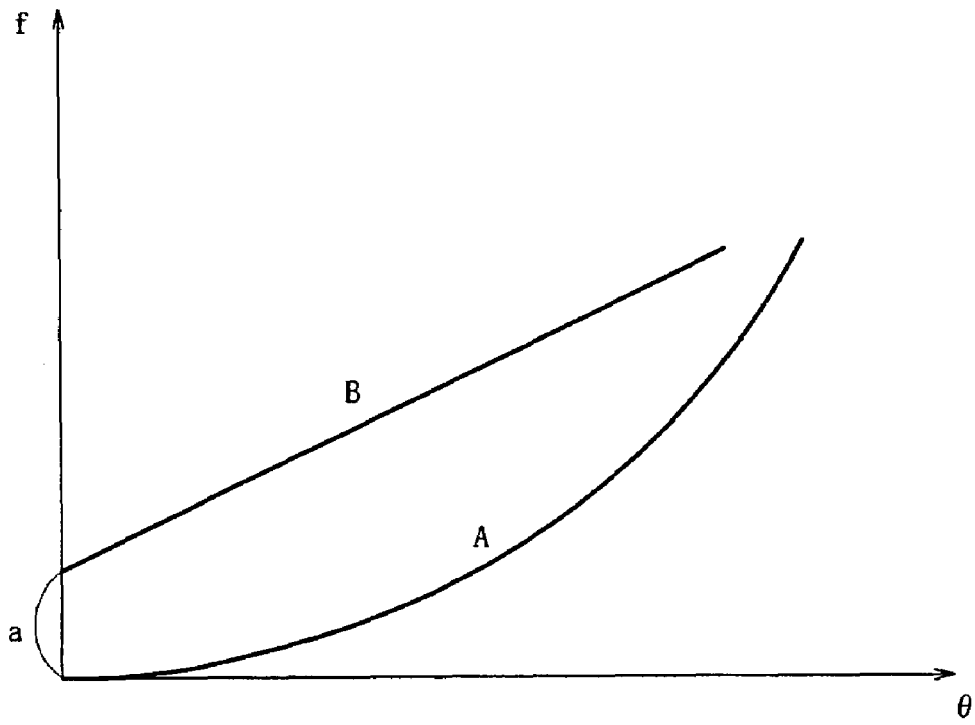
FIG. 8 is a graph showing a relationship between the strength of pressure applied to the strike and the starting angle of the foot board structure in relation to the bottom surface structure.
Figure 10:
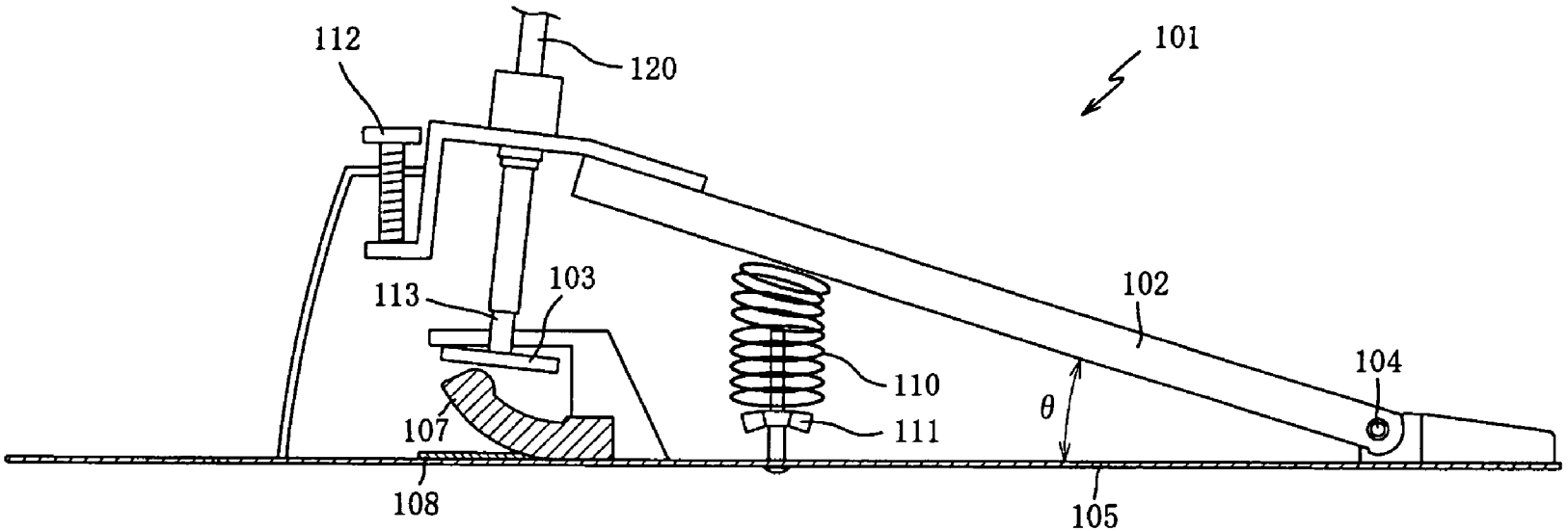
FIG. 10 is an illustration of another conventional style electronic percussion instrument foot pedal device.

FIG. 8 shows a diagrammatic chart depicting the rotation angle θ relative to the load f. The abscissa axis of the diagrammatic chart represents the rotation angle θ of a footboard relative to the bottom plate, and the ordinate axis represents the load f. In the diagrammatic chart, Line A shows characteristic of a pedal device for acoustic bass drums, while Line B shows characteristic of a pedal device as shown in FIG. 10.

For Line A, when the rotation angle θ is small, the load f is small, and the incremental increase of a load is also small. However, if the rotation angle θ becomes large, the load will increase and the incremental increase in load is also large. On the other hand, Line B is a characteristic corresponding to an old pedal device for electronic musical instruments as shown in FIG. 10. For Line B, when the rotation angle θ is 0, the initial load "a" has occurred. This initial load "a" is set with the fly nut. If the rotation angle θ becomes large, a load will increase proportionally.

According to the embodiments of the present invention, a pedal device for an electronic musical instrument has the same weighted characteristics as Curve A. As a result, it approximates a feeling of actuation of a pedal device for acoustic bass drums to provide a good actuation feeling for electronic musical instruments.

According to a second embodiment of the present invention, the spring is attached to the foot pedal board as well as to the bottom surface structure, and regulates the up and down as well as the resting movement of the foot pedal board along with a first securing structure. A second securing structure is connected to the second end of the spring structure. Thus by utilizing these two securing structure components in conjunction with the spring structure, the electronic percussion instrument pedal device does not need an arm connected to the foot pedal board as in other devices of a similar nature. The pedal thus can be easier to use and more comfortable for the user. Another result is that it becomes much less likely that there will be missed strikes.

According to a third embodiment of the present invention and also expanding upon the first and second embodiments of an electronic percussion instrument pedal device, sensors are composed of two insulated electrodes formed on bottom plates and a sensor pressing member which functions to short circuit the two electrodes with rotation of a footboard. A sensor pressing member changes continuously the surface area which contacts the two insulated electrodes, according to the angle of the bottom plates relative to the operating plane of the footboard. As a result, an amount of electrical resistance is dependent upon the angle of the footboard relative to the bottom plates. Therefore, the amount of actuation of the foot pedal can be detectable by measuring the electrical resistance.

Also, with this structure, there is no need for an actual beater, and the possibility of a beater making any secondary and unnecessary sounds can be eliminated. The result can be a virtually silent pedal system, except for the desired electronically generated sound.

According to a fourth embodiment of the present invention, and also expanding upon the third embodiment of an electronic percussion instrument pedal device, a first securing structure is attached to an end of the foot board structure and any movement of the foot board structure activates and is continuously monitored by the sensor electrodes discussed above. With the movement of the above mentioned components acting as an actuator for the sensing system, the need for a large number of sensors is reduced. Thus, with the reduction in sensors the overall pedal device structure and the can be easier to move, assemble, disassemble and play.

Figure 1:
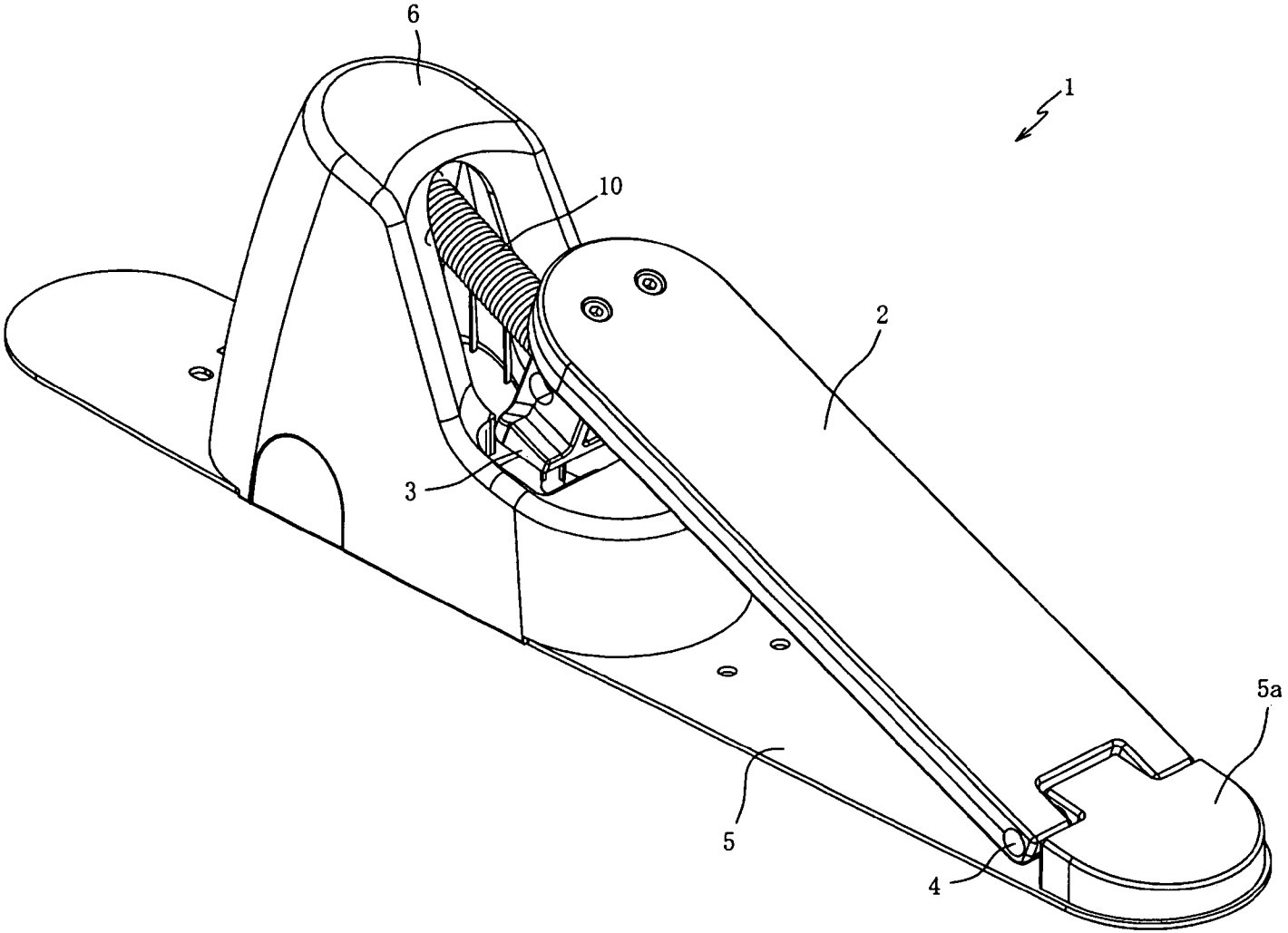
FIG. 1 is a perspective view of an electronic percussion instrument foot pedal device according to an embodiment of the present invention.

A pedal device 1 according to an embodiment of the invention is shown in FIG. 1, in an external view. The electronic percussion instrument pedal device 1 includes a foot board structure 2, a weight 3, a movement component 4, a bottom surface structure 5, a cover 6, and a coil spring 10 arranged to prove a pulling force.

The bottom surface structure 5 is created to act as a base for the rest of the pedal device 1. Near a first end of the bottom surface structure 5, there is a movement component 4, which is attached to a linkage connection structure 5*a*. The other end of the bottom surface structure 5 is connected to the cover 6.

The foot board structure 2 is made of a suitable material and configuration to take a great deal of abuse from the repeated stepping of the user, such as, but not limited to high impact aluminum. A first edge of the foot board structure 2 is connected to the bottom surface structure 5 via the movement component 4. The foot board structure 2 is connected to a central location of the bottom surface structure 5 which allows for the optimal range and ease of movement.

At a second edge of the foot board structure 2, the weight 3 is connected by a screw to the bottom surface of the foot board structure 2. The coil spring 10 is connected (and may be stretched) from the weight 3 to a central portion of the cover 6. The weight 3 unit may be the same or similar kind of weight found on the bottom of the foot board structure of a traditional acoustic drum set up. Conventionally, this kind of weight functions to counter balance against the weight of the beater attached to the end of the foot board structure in an acoustic drum set up and has been made out of either iron or some other dense heavy metal. In embodiments of the present invention, the weight 3 may be configured to act as the weight and the actuator structure.

Figure 2:
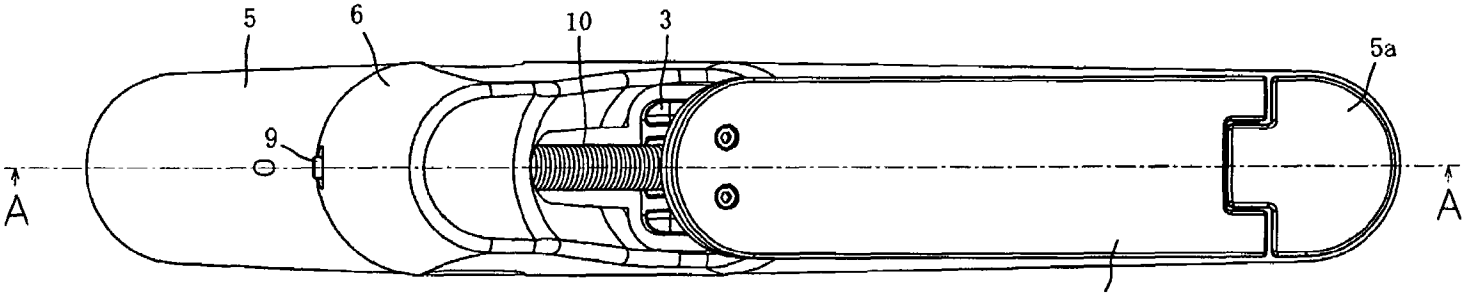
FIG. 2(*a*) is a top view of a pedal device according to the embodiment of FIG. 1.
Figure 2:
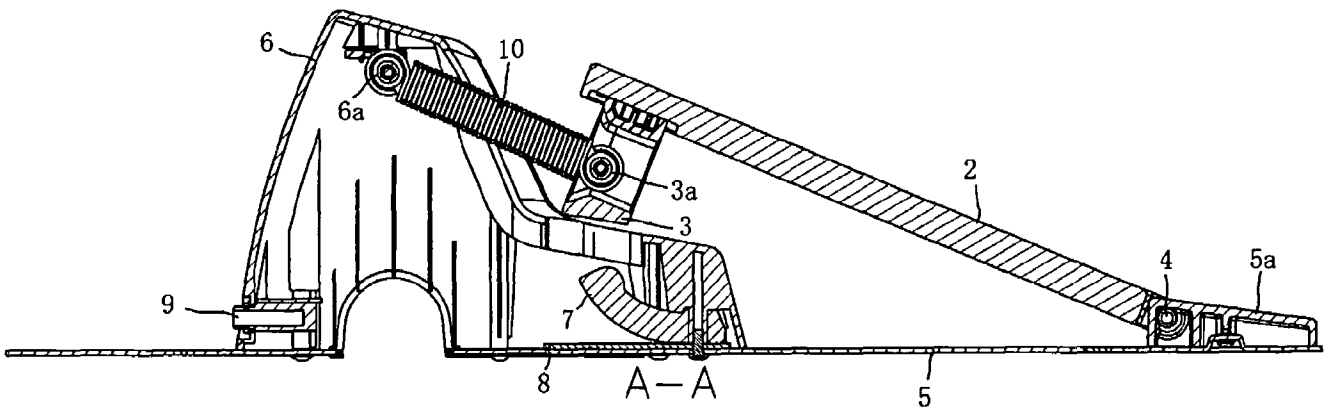

The electronic percussion instrument pedal device 1 of FIG. 1 is shown in a top-down view in FIG. 2(*a*). In FIG. 2(*b*), the electronic percussion instrument pedal device 1 is shown in a cross-section along line A of FIG. 2(*a*). In FIG. 2(*b*), an example of a connection of one end of the coil spring 10 to the weight 3 as well as a securing structure 3*a*. The coil spring structure 10 can freely rotate with the securing structure 3*a*. In the interior of the central portion the cover 6 is shown the connection of the coiled spring 10 to another securing structure 6*a*. The securing structure 6*a* acts to automatically control the movements of the coil spring 10.

The energy stored within the coiled spring structure 10 when the foot board structure 2 is not in use is kept in check by the combined restraint placed upon it by the movement component 4 as well as the securing structures 3*a* and 6*a*. When the foot board structure 2 is not is use, the components holding it and the spring in check generally keep the foot board structure 2 at rest at an angle (for example, but not limited to, from about 20 to about 30 degrees) relative to the bottom surface structure 5. When the foot board structure is depressed through action of the artist, the coil spring 10 expands and energy is created to return it back towards its normal length once the pressure has been removed.

Placed between the weight 3 and the bottom surface structure 5, is the sensor pressing member 7 as well as the sensor pattern 8. On the leading edge of the cover 6 is a connection jack 9. The sensor pressing member 7 may comprise, for example, but is not limited to a resiliently flexible pad of material, such as a pad of rubber. The sensor pressing member 7 is secured in a similar fashion as the electrodes and has one edge (the right edge in FIG. 2(*b*)) connected in a fixed relation to the bottom surface structure 5. The other edge (the left edge in FIG. 2(*b*)) is left free to come into contact with the underside of the weight 3 when the weight 3 is brought down by pressure applied to the foot board structure during play.

Figure 3:
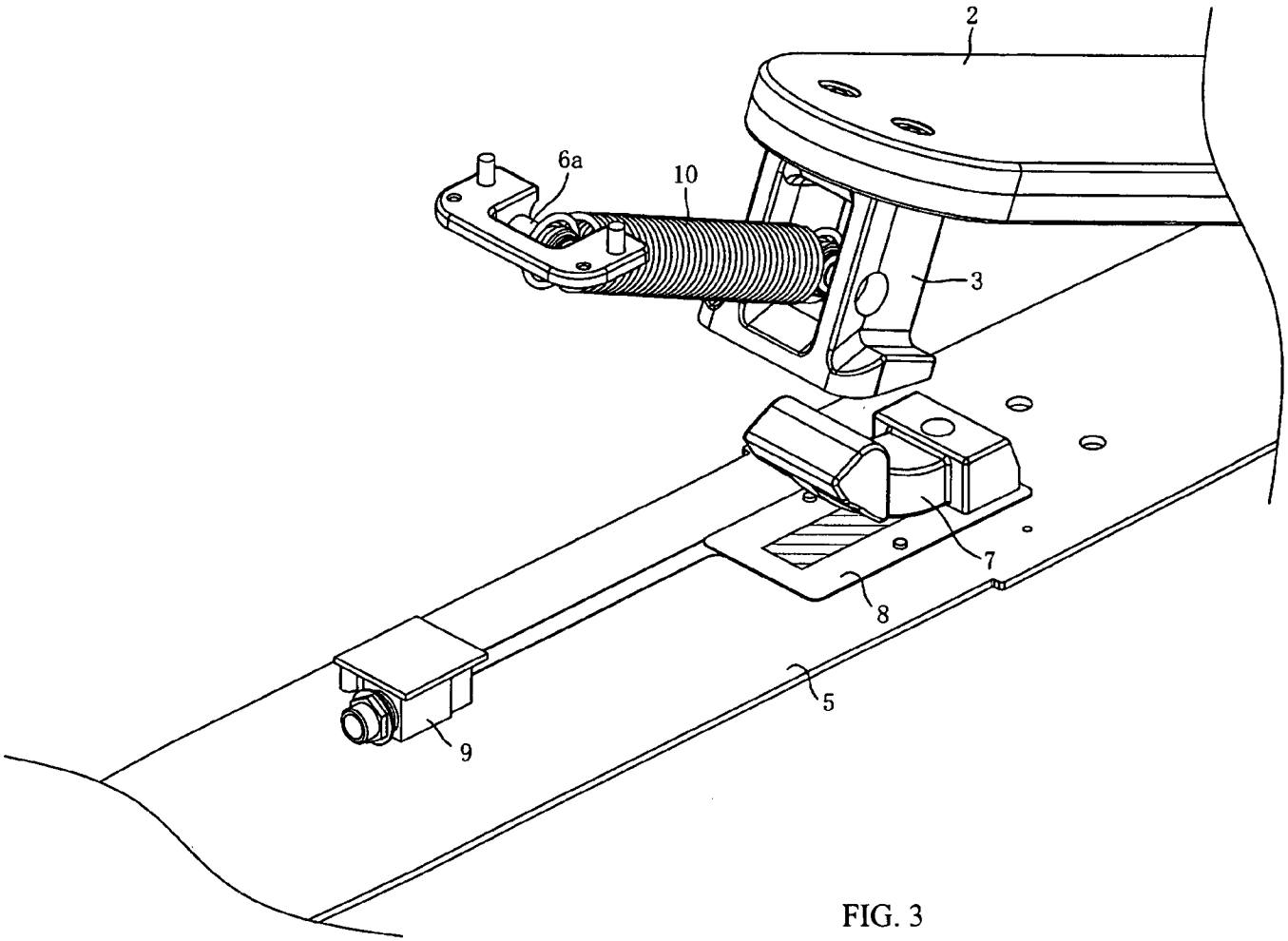
FIG. 3 is a perspective view showing a weight and a sensor of pedal device according to an embodiment of the present invention.

When the weight 3 is brought down as the pedal device is played, the sensor pressing member 7 is contacted by the bottom edge of the weight 3 and is forced in the direction toward the sensor pattern 8 to come into contact with the sensor pattern 8 on the bottom surface structure 5 (as shown in FIG. 3). The sensor can detect when the distance between the foot board structure 2 and the bottom surface structure 5 has changed, as well as the rate of that change.

The jack 9 is accessible from the outer edge of the cover 6. The jack 9 provides an electrical connection for communicating sensor data from the sensor pressing member 7 and sensor pattern 8. The jack 9 is arranged adjacent the bottom surface structure. The jack 9 provides an electronic connection to convey the sensor data as electronic signals for transmission or storage as well as to connect power to the sensor units in order for them to function.

Figure 4:
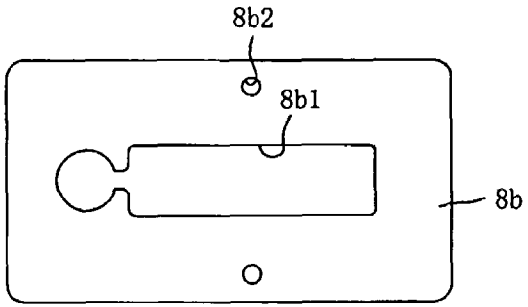
FIG. 4(*a*) shows a top layer film of a sensor pattern structure, FIG. 4(*b*) shows a spacer, and FIG. 4(*c*) shows a further layer of a sensor pattern film and their structures.
Figure 4:
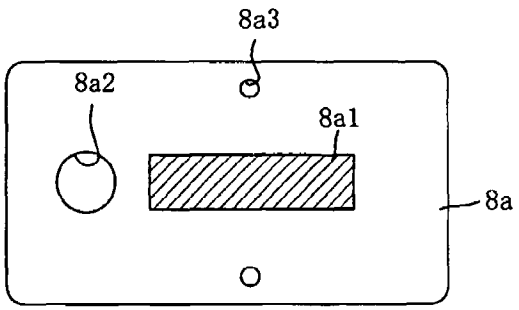
Figure 4:
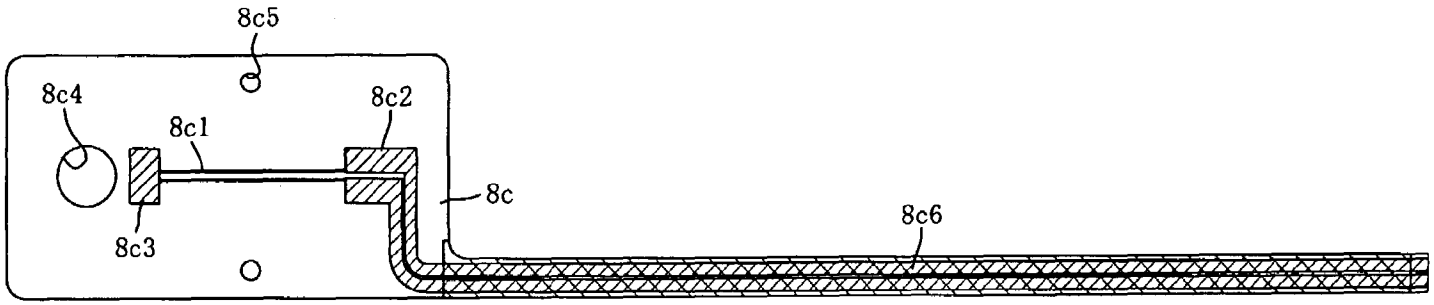

FIG. 3 shows the weight 3 as well as the sensor components. FIG. 3 shows the sensor pressing member 7 as well as the sensor pattern 8 provided on the top of the bottom surface structure 5. An example of a sensor pattern 8 and sensor pressing member 7 is illustrated in FIGS. 4(*a*)-(*c*). The sensor including the sensor pressing member 7 and pattern 8 operates by measuring the distance between two points by the electrical resistance between the points.

While the sensor pressing member 7 is not normally in contact with the sensor pattern 8, when the foot board structure 2 is sufficiently pressed during play, the pressing member 7 will press along its length against the sensor pattern 8 until both ends of the sensor pressing member 7 meet the sensor pattern 8.

The sensors are able to measure and determine the relative position of the foot board structure 2 and convert these measurements into signals for producing sounds as the foot board structure 2 is moved up and down. Along with the detection of the relative space between the foot board structure 2 and the sensor pattern 8, the rate of change can also be detected which allows the relative force of each pressure upon the foot board structure 2 to be measured. Utilizing these measurements of space and force upon the foot board structure 2, the sensors can be used to accurately recreate the sound which would come from an acoustic style drum.

With respect to FIG. 4(*a*)-(*c*), the sensor pattern 8 is described in further detail. FIG. 4(*a*) illustrates a top sensor film 8*a* as seen from above. FIG. 4(*b*) shows a spacer layer 8*b* and FIG. 4(*c*) shows a sensor pattern film 8*c*, each as seen from above.

The top sensor film 8*a* may be made from, for example, but not limited to a thin layer of polyester film or the like. In the center of the thin layer of top sensor film 8*a* is an electrical lead 8*a*1 made of an electrically conductive material, such as, but not limited to, silver paste or the like. Also, a connector such as, but not limited to, a bolt or the like is provided on one side of the sensor film 8*a* in order to attach the top layer sensor film 8 to the bottom surface structure 5. The top sensor film 8*a* is also connected to the bottom surface structure 5, for example, via a bolt through a hole 8*a*3.

The spacer 8*b* may be made of the same type of thin polyester film as the above mentioned sensor film. The spacer 8*b* may look similar to the film 8*a*. The spacer 8*b* has a central opening 8*b*1 that aligns with the silver paste center of the film 8*a*. Connectors, such as bolts or the like may extend through opening 8*a*2 and a corresponding opening in spacer 8*b* to hold the sensor pattern 8 to the bottom surface structure 5 as well as to the sensor pressing member 7. Thus, in addition to the connection point 8*b*1, a securing bolt through a hole 8*b*2 may hold the film 8*a*, spacer 8*b* and bottom surface structure 5 together.

The sensor pattern film 8*c* may be constructed of the same type of material as the film 8*a* and the spacer 8*b*, such as, but not limited to a thin layer of polyester film. The sensor pattern film 8*c* is connected to the rest of the sensor pattern 8 and the bottom surface structure 5 via a connective structure 8*c*6 and is, otherwise, similar outside to the top layer film 8*a* as well as to the spacer layer 8*b*.

In the sensor pattern 8 structure there are at the bottom layers two electrically conductive lines, such as, but not limited to carbon strips 8*c*1 running along the length dimension of the structure. These carbon strips 8*c*1 each run through the silver paste 8*c*2 sections and act as electrical leads connecting the silver paste 8*c*2 to the connective structure 8*c*6. The connective structure 8*c*6 provides an electrically conductive path for electrical signals communicated through the silver paste at various levels within this structure.

On one side of the sensor pattern film 8*c* (the left side in FIG. 4(*c*)) and aligned at the same location as the connective bolt opening 8*a*2 is the connective structure, such as, but not limited to a bolt opening 8*c*4 for receiving a bolt or the like, to help hold the sensor pressing member 7, the sensor pattern 8 and the bottom surface structure 5 together. Also adjacent the length of the carbon connective strips 8*c*1 is another connective structure, such as, but not limited to a bolt opening 8*c*5 for receiving a bolt or the like which to help hold together the sensor pressing member 7, the sensor pattern 8 and the bottom surface structure 5.

The bottom of the sensor pattern film 8*c*, which is part of the sensor pattern 8, is attached to the bottom surface structure 5. Lying above the film 8*c* is the spacer layer 8*b*, and connected above the spacer layer 8*b* is the top sensor film layer 8*a*. The top sensor film layer 8*a*, the spacer film layer 8*b* as well as the sensor pattern film 8*c* are all held together and to the bottom surface structure 5 by multiple connectors, such as, but not limited to small bolts or the like.

In addition to being secured to the bottom surface structure 5, the two carbon strips 8*c*1 are connected to and extend from the bottom surface structure 5, through a central region in the sensor pattern film 8*c* that is aligned with the silver paste 8*a*1 on the top sensor layer 8*a* and is aligned with the corresponding opening in the central region of the film spacer 8*b*.

When the sensor pressing member 7 is not being depressed or moved during play, the film space layer 8*b* acts as a separator of the top sensor layer 8*a* and the sensor film pattern 8*c*. In this state the carbon strips 8*c*1 do not make contact with the internal silver paste 8*a*1 on the top sensor layer 8*a*. It is in this way that the connection between the various electrical components function to send signals. Without contact the carbon strips 8*c*1 do not electrically connect to the silver paste 8*a*1, thus forming an open circuit between the carbon strips 8*c*1.

When the sensor pressing member 7 is being depressed or moved during play, the spacer film layer 8*b* is compressed and no longer fully separates the top sensor layer 8*a* from the sensor film pattern 8*c*. In this state the carbon strips 8*c*1 make contact with the silver paste 8*a*1 to provide an electrical connection. However, once there is contact, even relatively slight changes in the position of the sensor pressing member 7 can be sensed. As the foot board 2 is depressed from its un-depressed state, the conductive material 8*a*1 begins to contact the conductive material 8*c*3 first. As the foot board 2 is depressed further, the sensor pressing member 7 begins to flatten down and push on the top layer 8*a*. Further depression of the foot board 2 causes further flattening and pressing of the sensor pressing member 7 on the top layer 8*a*, such that the position at which the carbon strips 8*c*1 are contacted by the conductive material 8*a*1 changes and approaches the conductive material 8*c*2. The resistance between the carbon strips 8*c*1 changes, as the location at which the conductive material 8*a*1 contacts the carbon strips 8*c*1 changes. Accordingly, a detection of the resistance between the carbon strips 8*c*1 can be taken, for example, from electrodes (not shown) attached to the electrical connective structure 8*c*6, where the detected resistance is dependent on the location of contact between the conductive material 8*a*1 and the carbon strips 8*c*1 and, thus, the amount of depression of the foot board 2. In one example embodiment, a processor may be connected to the electrodes (not shown) attached to the electrical connective structure 8*c*6, where the processor may be programmed or otherwise configured to detect a resistance level and determine the pedal board position, based on the detected resistance.

Figure 5:
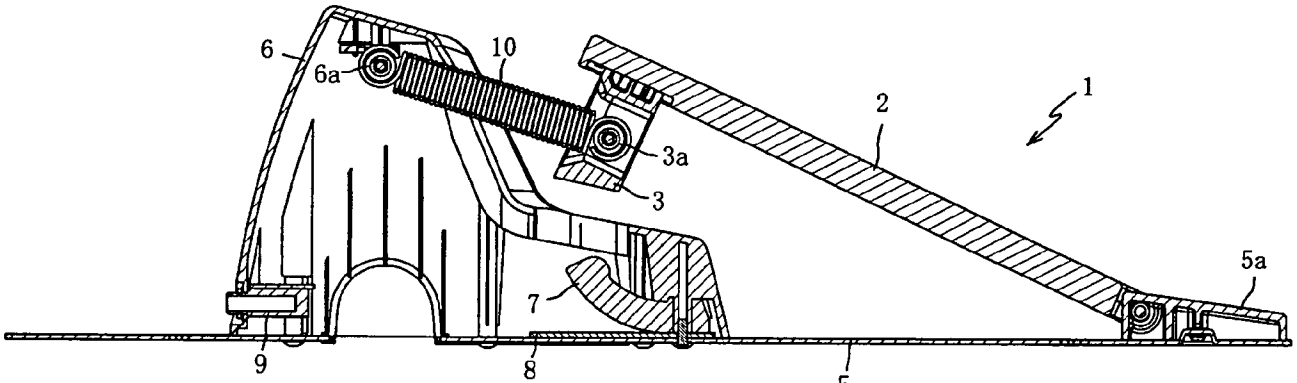
FIG. 5(*a*) is a side, cross-section view of a foot board structure in a resting position.
Figure 5:
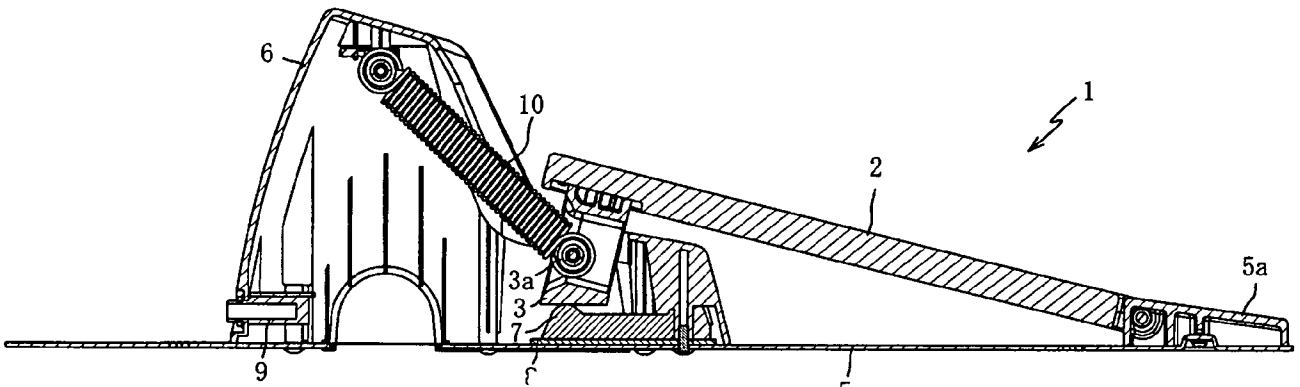

FIG. 5(*a*) shows a position of the foot board 2 when it is not being used, while FIG. 5(*b*) shows a position of the foot board 2 when it is being depressed during play. When the foot board 2 is not in use as shown in FIG. 5(*a*), the coil spring 10 is held or locked in place by its own tension and by the shaft or other suitable securing structures 3*a* and 6*a*, and is also held tight by the connective structure 4. Thus, when not in use the foot pedal 2 is held in the above described position. When the foot board 2 is depressed during use the securing structures 3*a* and 6*a* stretch into a different position in order to allow the foot pedal to operate freely and without obstruction or resistance. A change in the positions of the securing structures 3*a* and 6*a* relative to each other, even a very small change, causes the securing structures 3*a* and 6*a* to release and allow the foot board 2 to move freely. Because the change in relative position which locks and unlocks the securing structures 3*a* and 6*a* can be relatively small, the foot pedal is able to be unlocked with a simple light push and relocked into resting position by withdrawing the pressure previously applied.

The load of this pedal device for electronic bass drums is approximated to the characteristic of the pedal device for the acoustic bass drums of the curve A shown in FIG. 8. As a result, this pedal device provides a good actuation feeling for electronic bass drums.

When the foot board 2 is not operated on the pedal device 1, the foot board 2 is fixed at an angle relative to the bottom surface structure 5 by the coil spring 10. If the foot board 2 is stepped on, the coil spring 10 will stretch and a load (stability) will become strong. As a result, when the foot board 2 is in a position near the position in which it is not stepped on, the load is initially relatively light and then becomes heavier as the user continues to further step on the foot board 2. This is approximated to the action of an acoustic bass drum, and a good actuation feeling.

As described above, an electronic percussion instrument foot pedal device 1 may be configured such that, when the foot board 2 are not in use the angle at which the foot board 2 is held relative to the bottom surface structure 5 is dictated by the adjustment of the securing structures 3*a* and 6*a* and the coil spring 10 and, when a user wants to begin play, the user need only apply pressure to unlock the foot board 2 and the coil spring will release to full extension thus allowing for instant playability. In addition, according to embodiments of the present invention, as compared to traditional acoustic bass drum configurations, the resistance of the spring can also be set, thus allowing the user to change the strength necessary to get the same sound. For example, the user may adjust the strength in a manner to avoid becoming overly tired during a performance.

Figure 6:
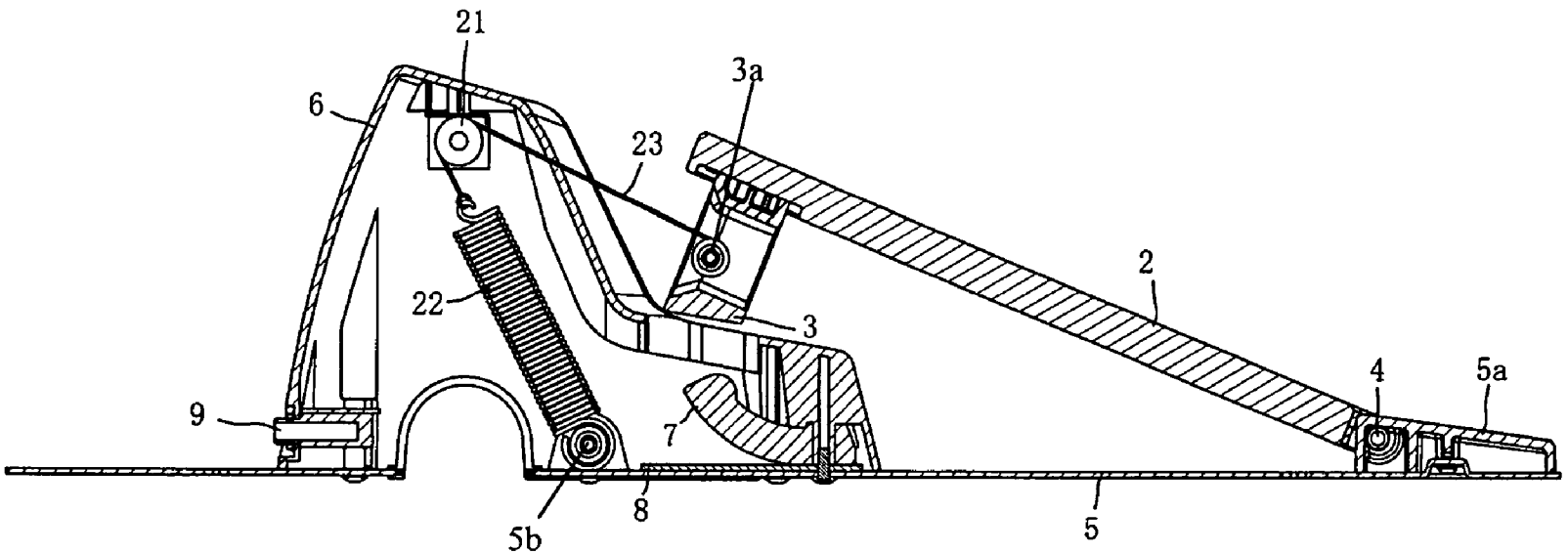
FIG. 6 is a side, cross-section view illustration of a foot pedal device according to a second embodiment of the present invention.

FIG. 6 shows a side, cross-section view of an electronic percussion instrument foot pedal device according to a second embodiment of the present invention.

In the first embodiment described above, the second securing structure 6*a* was connected to the cover 6 and one end of the coil spring 10. In addition, the foot board 2 was restrained by the first securing structure 3*a*. However, in an electronic percussion instrument foot pedal device according to a second embodiment of the present invention, the foot board is held in place not by the second securing structure 6*a* attached to the cover 6, but by the pulley 21. Also, one end of a coil spring 22 is held in place with respect to the bottom surface structure 5 by a securing structure 5*b* and the second end of the coil spring 22 is held by one end of a wire 23 that is wrapped around the upper edge of the pulley 21. The other end of the wire 23 is attached to the end of the foot board 2 and is held in place by the weight 3 as well as the first securing structure 3*a*.

The pulley 21 is positioned on top of the cover 6 and functions as a securing device and also as a receiving point for the wire 23. The wire 23 may be, for example, a thin steel wire that is flexible and of sufficient strength to bear the force of the spring 22.

In the embodiment of FIG. 6, the foot pedal 2 is held into place in a rest position when not being used by a combination of the coil spring 22, the pulley 21, the first securing structure 3*a* as well as the connective structure 4.

When the foot board 2 is to be played, the user need only step on it with a degree of pressure which will pull the wire 23 and stretch the coil spring 22. This embodiment, as with the first embodiment, may be configured to resemble the force characteristics of an acoustic bass drum. However, embodiments of the present invention may be configured with a foot pedal configuration and recoil characteristics that can be easier to adapt to and play.

Figure 7:
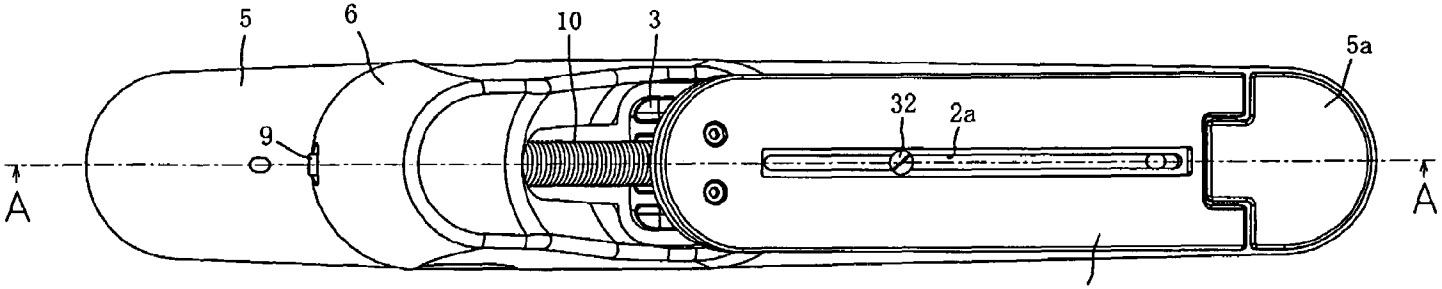
FIG. 7(*a*) is a top view of a foot pedal device according to a third embodiment of the present invention.
Figure 7:
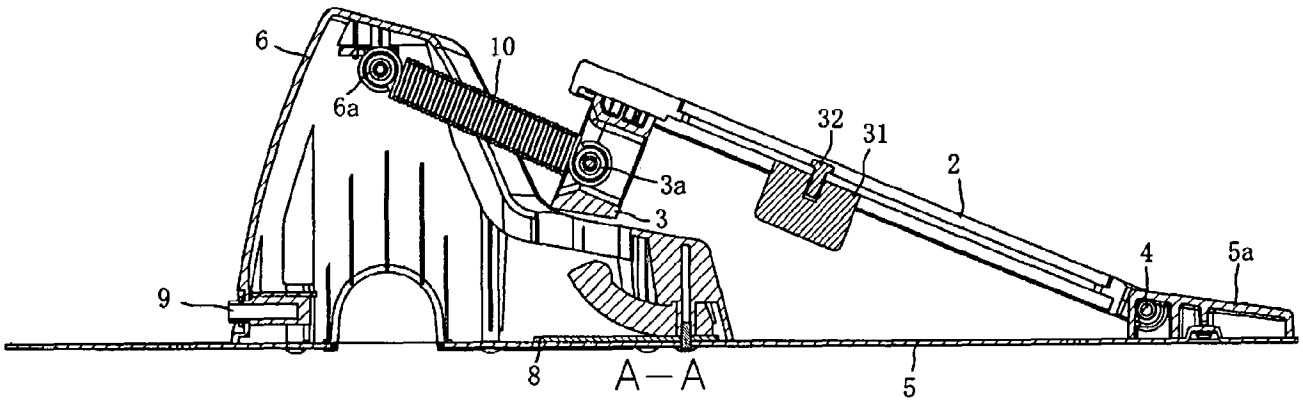

An electronic percussion instrument foot pedal device according to a third embodiment of the present invention is described with referenced to FIGS. 7(*a*) and 7(*b*). FIG. 7(*a*) shows a top down view of an electronic percussion instrument foot pedal device 1. FIG. 7(*b*) shows a side, cross-section view taken along the line A to A in FIG. 7(*a*).

In the first embodiment, the foot board 2 was attached to the weight 3 by a series of screws. In the third embodiment, a connective groove 2*a* extends along the length of the foot board 2. A weight 31 is connected to the connective groove 2*a* by at least one screw 32, thus adding flexibility, stability and much improved strength to the foot board 2. The screw 32 may be screwed in from the bottom of the foot pedal 2 in such a way as to insure that while they will firmly help attach the weight to the foot pedal and that they will not protrude from the top of the foot pedal 2. The weight 31, like weight 3, may be made of either iron or another dense heavy metal and has a threaded screw hole for the screw 32 to be inserted. In one embodiment, the screw 32 may be configured with a slotted head to receive a flat-head screw driver. However, other embodiments may employ other suitable screw configurations, including star (Phillips) style, hexagon (Allen) style, or the like.

In that regard, the user may help minimize failure while performing. By utilizing a screw driver as described above, this weight 33 will be extremely firmly attached to the foot board 2.

The above description and the accompanying drawings explain and illustrate some of the various iterations of electronic percussion instrument foot pedal device embodiments of the present invention. However, those are but a few, non-limiting examples of the possible iterations of the present invention.

For example, the above embodiments use a coil spring system to balance and reflect the energy of the foot board during play but a user could alternatively use other spring configurations, including, but not limited to a flat (leaf) style spring.

Also, in the first embodiment, the foot board 2 used the weight 3 and the securing structures as well as the spring to move to the rest position. However, in the third embodiment, a connective groove 2*a* was added to make the resting position of the foot pedal 2 more efficient by being able to secure different and greater weights to the foot board 2. Thus the performer would be able to set a preference as to the amount of weight and resistance desired to have on their foot board.

Also in the above embodiments, the coil spring 10 was restrained by the securing structures 3*a* and 6*a*. However, the position and degree of securing from these components can be adjusted, which allows the user to set preferred resistance and resting positions for the foot boards at any desired angle.

What is claimed is:

1. An electronic percussion instrument pedal device, comprising:

a bottom surface structure;

a foot board structure pivotally connected to the bottom surface structure;

a spring arranged to impart a spring tension force on the foot board structure;

a sensor arranged for sensing movement of the foot board structure relative to the bottom surface structure;

wherein the spring has a longitudinal dimension and is arranged to rotate at least partially about an axis generally perpendicular to the longitudinal dimension of the spring as the foot board structure pivots relative to the bottom surface structure.

2. An electronic percussion instrument pedal device as recited in claim 1, further comprising:

a first securing structure for securing one end of the spring in a fixed relation relative to the foot board structure; and a second securing structure for securing a second end of the spring at a predetermined height above the bottom surface structure.

3. An electronic percussion instrument pedal device as recited in claim 2, wherein the sensor is supported by the bottom surface structure and includes first and second electrodes and a sensor pressing member for causing electrical contact between the first and second electrodes along a length of the first and second electrodes that continuously changes as the foot board structure pivots relative to the bottom surface structure.

4. An electronic percussion instrument pedal device as recited in claim 1, wherein the sensor is supported by the bottom surface structure and includes first and second electrodes and a sensor pressing member for causing electrical contact between the first and second electrodes along a length of the first and second electrodes that continuously changes as the foot board structure pivots relative to the bottom surface structure.

5. An electronic percussion instrument pedal device as recited in claim 3, wherein foot board structure is pivotally connected to the bottom surface structure adjacent one end of the foot board structure and wherein the first securing structure is arranged adjacent an end of the foot board structure that is opposite to the end that is pivotally connected to the bottom surface structure.

6. An electronic percussion instrument pedal device as recited in claim 1, wherein the bottom surface structure has a generally horizontal surface and the spring has a longitudinal dimension that extends in a direction that is not perpendicular to the generally horizontal surface of the bottom surface structure when the foot board is not pivoted relative to the bottom surface structure.

7. An electronic percussion instrument pedal device, comprising:

a bottom structure;

a foot board structure pivotally connected to the bottom structure;

a spring arranged to impart a spring tension force on the foot board structure;

a sensor arranged for sensing movement of the foot board structure relative to the base structure;

wherein the bottom surface structure has a generally horizontal surface and the spring has a longitudinal dimension that extends in a direction that is not perpendicular to the generally horizontal surface of the bottom surface structure when the foot board is not pivoted relative to the bottom surface structure.

8. An electronic percussion instrument pedal device as recited in claim 7, further comprising:

a first securing structure for securing one end of the spring in a fixed relation relative to the foot board structure; and a second securing structure for securing a second end of the spring at a predetermined height above the bottom surface structure.

9. An electronic percussion instrument pedal device as recited in claim 8, wherein the sensor is supported by the bottom surface structure and includes first and second electrodes and a sensor pressing member for causing electrical contact between the first and second electrodes along a length of the first and second electrodes that continuously changes as the foot board structure pivots relative to the bottom surface structure.

10. An electronic percussion instrument pedal device as recited in claim 7, wherein the sensor is supported by the bottom surface structure and includes first and second electrodes and a sensor pressing member for causing electrical contact between the first and second electrodes along a length of the first and second electrodes that continuously changes as the foot board structure pivots relative to the bottom surface structure.

11. An electronic percussion instrument pedal device as recited in claim 9, wherein foot board structure is pivotally connected to the bottom surface structure adjacent one end of the foot board structure and wherein the first securing structure is arranged adjacent an end of the foot board structure that is opposite to the end that is pivotally connected to the bottom surface structure.

12. An electronic percussion instrument pedal device, comprising:

a bottom surface structure;

a foot board structure having a first end pivotally connected relative to the bottom surface structure to allow the foot board to pivot relative to the bottom surface structure, the foot board structure having a second end opposite to the first end;

a cover structure attached to the bottom surface structure;

a spring having one end attached to the cover structure at a position above the bottom surface structure, and a second end attached adjacent the second end of the foot board structure at another position above the bottom surface structure, the spring having a spring tension sufficient to hold the foot board structure at an angle greater than 0 relative to the bottom surface structure, yet allow pivotal motion of the foot board relative to the bottom surface structure upon application of a suitable force on the foot board structure;

a sensor connected to detect changes in the angle of the foot board structure relative to the bottom surface structure.

13. An electronic percussion instrument pedal device as recited in claim 12, further including a first securing structure connecting the one end of the spring to the cover structure and a second securing structure connecting the second end of the spring to the foot board structure.

14. An electronic percussion instrument pedal device as recited in claim 12, wherein the sensor comprises:

a first film layer having a conductive material;

a second film layer disposed on the first film layer, the second film layer being made of electrically insulating material and having an opening aligned with the conductive material on the first film layer; and a third film layer disposed on the second film layer, the third film layer having an electrically conductive material arranged in alignment with the opening in the second film layer;

wherein the second film layer electrically separates the conductive material on the first film layer from the conductive material on the third film layer when pressure is not applied to the third film layer; and wherein the conductive material on the first film layer is able to contact the conductive material on the third film layer through the opening in the second film layer, when sufficient pressure is applied to the third film layer.

15. An electronic percussion instrument pedal device as recited in claim 14, further comprising:

a weight attached to the foot board structure for movement with pivotal movement of the foot board structure; and a sensor pressing member attached to the bottom surface structure at a position to be pressed by the weight, upon the foot board structure being pivoted a sufficient amount relative to the foot board structure, the sensor pressing member being arranged to transfer a pressing force from the weight to the sensor, to cause the conductive material on the first film layer to contact the conductive material on the third film layer through the opening in the second film layer, when sufficient pressure is applied to the sensor pressing member by the weight.

* * * * *